United States Patent [19]

Linder et al.

[11] Patent Number: 5,056,309

[45] Date of Patent: Oct. 15, 1991

[54] INTERNAL COMBUSTION ENGINE, PARTICULARLY OTTO ENGINE

[75] Inventors: Ernst Linder, Mühlacker; Wilhelm Hertfelder, Steinenbronn, both of Fed. Rep. of Germany; Hans Lenz, Vienna, Austria; Erich Breuser, Vaihingen/Enz, Fed. Rep. of Germany; Winfried Moser, Ludwigsburg, Fed. Rep. of Germany; Hans Schlembach, Mühlacker, Fed. Rep. of Germany

[73] Assignee: Robert Bosch GmbH, Stuttgart, Fed. Rep. of Germany

[21] Appl. No.: 346,114

[22] PCT Filed: May 28, 1988

[86] PCT No.: PCT/DE88/00314

§ 371 Date: Mar. 3, 1989

§ 102(e) Date: Mar. 3, 1989

[87] PCT Pub. No.: WO89/00241

PCT Pub. Date: Jan. 12, 1989

[30] Foreign Application Priority Data

Jul. 3, 1987 [DE] Fed. Rep. of Germany ..... 3722048

[51] Int. Cl.[5] ..... F02M 25/06

[52] U.S. Cl. ..... 60/278; 123/568

[58] Field of Search ..... 60/278; 123/568

[56] References Cited

U.S. PATENT DOCUMENTS

| | | | |
|---|---|---|---|
| 2,354,179 | 7/1944 | Blanc | 123/568 |
| 3,512,509 | 5/1970 | Daigh | 123/568 |
| 4,117,813 | 10/1978 | Yamashita | 123/568 |
| 4,278,063 | 7/1981 | Nakamura | 123/568 |
| 4,306,533 | 12/1981 | Matsumoto | 123/568 |
| 4,454,852 | 6/1984 | Hasegawa | 123/568 |
| 4,475,524 | 10/1984 | Eckert | 123/568 |
| 4,693,226 | 9/1987 | Choma | 123/568 |

FOREIGN PATENT DOCUMENTS 3025106 8/1986 Fed. Rep. of Germany .

*Primary Examiner*—Douglas Hart

*Attorney, Agent, or Firm*—Michael J. Striker

[57] ABSTRACT

A multiple cylinder internal combustion engine comprising an exhaust recycling system including an exhaust return line connected with an exhaust manifold of the internal combustion cylinder and exhaust metering device comprising a first metering member connected with a throttle valve of an intake manifold for joint actuation therewith and a plurality of turbulence nozzles, each of the turbulence nozzles being located in an immediate vicinity of an inlet valve of each combustion cylinder communicating a combustion chamber of a respective combustion cylinder with the intake manifold, the exhaust recycling system further comprising a header reservoir located downstream of said first metering member, and a plurality of separate exhaust return lines communicating the header reservoir with the plurality of turbulence nozzles, respectively.

15 Claims, 3 Drawing Sheets

33
n
$\vartheta_W$
$\alpha_{DK}$
$\lambda$
$L_i$
$t_i$
$\alpha_Z$
10
11
12
13
14
15
16
17
18
19
20
21
22
23
24
25
26
27
28
29
30
31
32
34

INTERNAL COMBUSTION ENGINE, PARTICULARLY OTTO ENGINE

BACKGROUND OF THE INVENTION

The invention relates to an internal combustion engine, particularly an Otto engine.

Exhaust recycling systems are provided in internal combustion engines, particularly in so-called Otto engines, for reducing emission of pollutants with the exhaust, particularly nitric oxide. Formation of nitric oxides is dependent on temperature and the oxygen content in the combustion chamber of combustion cylinders. By mixing the exhaust with a fuel-air mixture, both are reduced and the pollutant emission is decreased.

In a known exhaust recycliner system for an Otto engine with carburetor, a second metering member is designed as an annular throttle which connects an exhaust return line with an intake manifold downstream of the carburetor. The exhaust is fed under excess pressure to the gasoline-air mixture in the intake manifold via this annular throttle. The first metering member arranged upstream of change to the second metering member in the exhaust recycling flow, is constructed as a throttle valve which is coupled with the carburetor throttle valve by a rod linkage. At a low intake pipe pressure determined by the position of the carburetor throttle valve, the recycling portion of the exhaust fed to the intake manifold is determined by a position of the throttle valve in the exhaust return line. This throttle valve becomes inactive at a predetermined intake pipe pressure, and the exhaust recycling portion is exclusively determined by the annular throttle and decreases as the intake pipe pressure increasing. It is only permissible to recycle a relatively small amount of the exhaust with this exhaust recycling system is a drop in the output of the internal combustion engine is to be avoided.

SUMMARY OF THE INVENTION

The object of the invention is to provide, the internal combustion engine, in which the mixture preparation for every cylinder is substantially improved, particularly when the fuel is injected into the inlet chamber by a so-called Jetronic, by direct feed of the hot exhaust flowing out of the exhaust return line at high flow velocity to the individual inlet valves. The object of the invention is achieved by forming the second proportioning member which is located downstream i the exhaust recycling flow, as a unit comprising a plurality of turbulence nozzles, one nozzle for each cylinder. A header reservoir is connected downstream of the first proportioning member in the exhaust recycling flow, and separate exhaust return line connect the header reservoir with the turbulence nozzles. The turbulence nozzles produce a very high charging motion in the combustion chamber. The combustion of the fuel-air mixture in the combustion chambers is accordingly substantially improved as a whole, so that a higher exhaust recycling rate can be provided at the same output, which leads to a saving of fuel during every cylinder charge. The internal combustion engine as a whole requires less fuel, already leading to a reduction of the pollutant emission, which is then further reduced with the exhaust recycling system. Turbulence nozzles are known and are used for feeding by-pass air into the combustion chamber of combustion cylinders.

The recycling exhaust is only fed via a turbulence nozzle in each instance which is associated with a respective cylinder executing an intake stroke. This increases the discharge flow speed of the exhaust to the turbulence nozzle and, accordingly, the effect on the charging movement of the mixture fed to the combustion chamber of the respective cylinder of the internal combustion engine.

In an advantageous manner, moreover, the air supply via the intake pipe is in no way impeded, the density of the charge of the combustion chambers is improved and a very accurate control of the exhaust recycling volume is achieved. This also relies on the fact that no exhaust reaches the intake conduit or is introduced there in an uncontrolled manner as long as the respective cylinder does not communicate with the intake conduit for the purpose of suction.

By shifting the first metering member to the exhaust manifold and, accordingly, into the area of high temperature, contamination of the first metering member with impurities, soot and condensation deposits which occur in the cooled-down exhaust. The first proportioning member, which is constructed as a controlling mechanism, e.g. throttle valve or metering valve, accordingly, has a longer service life, and the drift of the exhaust recycling rate is smaller.

Providing a temperature-controlled valve, preferably a bimetal valve, in the exhaust return line directly at its branching off from the exhaust manifold prevents exhaust recycling when the internal combustion engine is cold, since the valve keeps the exhaust return line closed during the hot-running of the internal combustion engine.

Supply of more or less high exhaust recycling rates delays the ignition of the mixture in the combustion chamber, which is compensated for by a corresponding shifting forward of the ignition time, that is, the ignition angle $\alpha_Z$. As a result of impurities and deposits in the metering members, a decrease in the exhaust recycling amounts cannot be avoided, at least in the long run, while the metering members remain unchanged. When the ignition angle is constantly shifted forward pre-ignition, overheating, and finally destruction of the combustion pistons occur. This is prevented, according to another feature of the invention, by regulating the ignition points to optimal combustion position in the combustion chamber with an electronic control device, to which in addition to other parameters for controlling the ignition angle and the injection period in injection systems, such as throttle valve position, speed and temperature, also communicated configuration of the combustion process in the combustion chambers. This combustion configuration can be detected optically in a known manner in that the light configuration in the combustion chamber is measured by a spark plug with built-in translucent rod. The optimal ignition point is reached when the light maximum occurs at a predetermined time. However, it is also possible to detect the combustion configuration by measuring the pressure in the combustion chamber, where the ignition time is, in turn, characterized by the time of the pressure maximum.

According to another feature of the invention, the air index measured by a lambda probe in the exhaust manifold, is also communicated to the electronic control device. The electronic control device then adjusts the ignition angle $\alpha_Z$ and the injection period $t_i$ in such a way that $\lambda=1$. The lowest possible pollutant emission values can then be achieved with a catalytic convertor located downstream of the exhaust manifold.

The present invention as to its construction so to its mode of operation will be best understood from the following description with reference to the accompanying drawings.

DESCRIPTION OF THE PREFERRED EMBODIMENT

Figure 1:
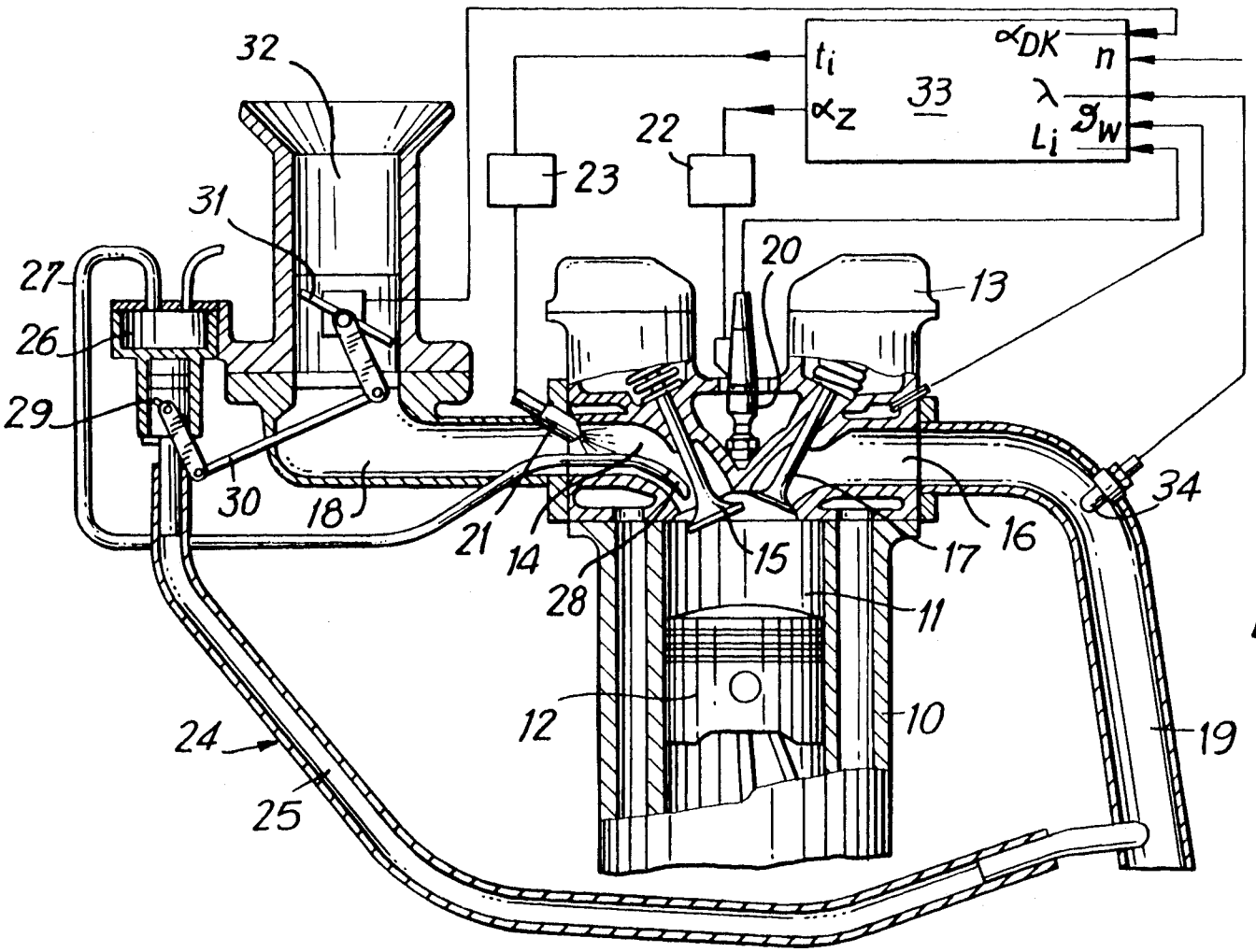
FIG. 1 shows a longitudinal sectional view of a first embodiment of an internal combustion engine with an exhaust recycling system invention.

A combustion cylinder 10 of the internal combustion engine, which is shown schematically in FIG. 1, has a combustion chamber 11 defined by a reciprocating piston 12, on the side, and by a cylinder head 13 of the combustion cylinder 10, on the other side. The cylinder head 13 has an inlet chamber 14, with an inlet valve 15 at the end of the inlet chamber which is adjacent to combustion chamber 11 and an outlet chamber 16 with an outlet valve 17 at the outlet chamber end which is adjacent to the combustion chamber 11. The inlet chamber 14 is connected to an exhaust manifold 19, possibly by an intermediate outlet connection piece. In addition, a spark plug 20 projecting into the combustion chamber 11 is screwed into the cylinder head 13. The spark plug 20 is constructed as a special spark plug. A translucent rod, through which the light emission in the combustion chamber 11 and its configuration can be detected, is installed in its center electrode. The spark plug 20 is connected with a high-voltage ignition device 22 which is only indicated in a schematic manner. Moreover, an injection nozzle 21, which projects into the inlet chamber 14, is arranged in the cylinder head 13. A distributor fuel injection pump designated by 23 injects a predetermined quantity of fuel into the inlet chamber 14 via the injection nozzle 21. A total of four identically constructed combustion cylinders 10 with cylinder heads 13 are provided in a four-cylinder internal combustion engine, all of which combustion cylinders 10 are connected to the intake manifold 18 and to the exhaust manifold 19.

In order to achieve a low emission of pollutants, the internal combustion engine is equipped with an exhaust recycling system 24. The recycling system 24 comprises an exhaust return line 25, which branches off from the exhaust manifold 19 and can be constructed e.g. as a special steel tube. A header reservoir 26, is connected with the exhaust return line 25. An exhaust return line 27 leads from the header reservoir 26 to the cylinder 10. The exhaust return line 27 leads into the inlet chamber 14 in the cylinder head 13 of the combustion cylinder 10 and ends there in a so-called turbulence nozzle whose opening is arranged immediately at the inlet valve 15. Such turbulence nozzles 28 are known and are used in internal combustion engines for supplying by-pass air to the combustion chamber of the combustion cylinders. The turbulence nozzle consists a curved tube with an outlet opening acting as a throttle. A throttle valve 29 is arranged at the place where the exhaust return line 25 opens into the header reservoir 26, and serves as a first metering member for the recycling portion of the exhaust. The throttle valve 29 is connected via a coupling rod 30 with an air throttle valve 31 which is arranged in a conventional manner in an air-intake connection piece 32 connected upstream of the intake pipe 18 and is adjusted via the accelerator pedal. In carburetor engines, this throttle valve 31 is arranged in the carburetor, which fits in this location, and is designated as carburetor throttle valve. The throttle valve 29 is also adjusted in a synchronous manner with the adjustment of the air throttle valve 31, wherein in the lower pressure range in the intake manifold 18 the exhaust recycling portion, which is fed into the header reservoir 26 and then, via the turbulence nozzle 28, to the respective combustion cylinder 10, first increases sharply from zero as the intake pipe pressure increases. After a predetermined position of the air throttle valve 31, the throttle valve 29 is completely opened and is, accordingly, without effect as metering member. The metered exhaust recycling portion is now only determined by the turbulence nozzle 28 forming a second metering member, wherein the metered amounts continuously decreases as the intake pipe pressure increases.

For optimal adjustment of the ignition angle $\alpha_Z$ and the fuel quantity which is injected via the injection nozzle 21 and determined by the injection period $t_i$, an electronic control device 33 is provided which control these two quantities in accordance with the operating parameters of the internal combustion engine. Such parameters are the position $\alpha_{DK}$ of the air throttle valve 31, the speed n of th internal combustion engine, the combustion chamber temperature which is detected by means of the temperature $\theta_W$ of the coolant water flowing through the cylinder head 13, the light configuration in the combustion chamber 11, and the air index $\lambda$ which is measured with a lambda prove 34 arranged in the exhaust manifold 19. The injection period $t_i$ and the ignition angle $\alpha_Z$, i.e. the ignition time with reference to the crank angle, are adjusted by the control device 33 in such a way that the combustion position is optimal, i.e. a maximum of energy conversion is achieved, and the air index in the exhaust $\lambda=1$. The lowest possible emission values are accordingly achieved with a catalytic convertor connected to the exhaust manifold 19.

Figure 2:
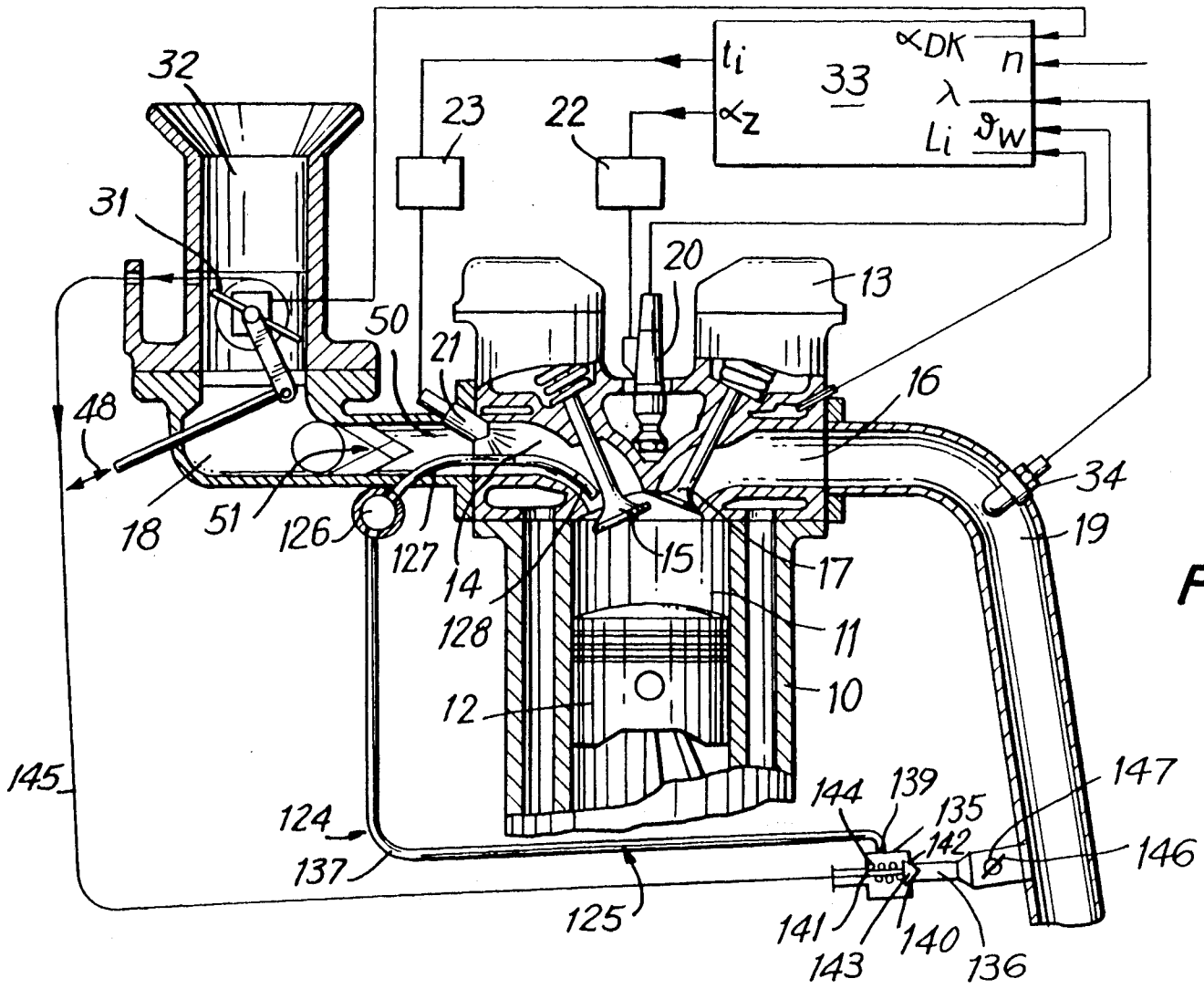
FIG. 2 shows a longitudinal section view of a second embodiment of an internal combustion engine according to the invention.

In the second embodiment shown in FIG. 2, some portions of the exhaust recycling system 24 are modified. The internal combustion engine itself is unchanged. But identical structural component parts are increased by 100 with respect to the exhaust recycling system.

In contrast to the exhaust recycling system in FIG. 1, the first metering member is not formed as a throttle valve in the exhaust recycling system 124 according to FIG. 2, but as a metering valve 135 which is arranged in the vicinity of the branching off of the exhaust return line 125 from the intake manifold 18, and the exhaust return line 125 is divided into an extremely short line segment 136 to the exhaust manifold 19, and a longer line segment 137 connected with the header reservoir 126. Additional short exhaust return lines 127 lead from the header reservoir 126 to the individual turbulence nozzles 128 which are arranged directly at every inlet valve 15 in the same manner as in FIG. 1.

The metering valve 135 comprises two valve portions 138 and 139, the valve portion 138 being connected with the line segment 136 and the valve portion 139 being connected with the line segment 137. The two valve portions 138 and 139 communicate with one another via a valve opening 140 which is controlled by a valve member 141 which cooperates with a valve seat 142 surrounding the valve opening 140. The valve seat 142 is annular the valve member 141 engaging the latter includes a conical closing body 143 biased by a valve closing spring 144 to its unactuated basic position. The valve member 141 is connected with the air throttle valve 31 via a Bowden cable or is immediately connected with the accelerator pedal indicated by a double arrow 48. The metering valve 135 works in the same manner as the throttle valve 29 in FIG. 1. By shifting the metering valve 135 directly into the high temperature range of the exhaust manifold 19, hotter exhaust gases flow through it than those flowing through the throttle valve 29 in FIG. 1, so that fewer soot and condensation deposits occur. Accordingly, the change in the exhaust recycling a mount metered in the same valve member position, which change is caused by such deposits, is substantially smaller.

A valve 146, with which the inlet of the exhaust return line 125 can be closed or opened, is additionally arranged in the line segment 136 between the metering valve 135 and the exhaust manifold 19. The valve 146 is controlled by a bimetal 147 in such a way that it keeps the exhaust return line 125 closed below a predetermined temperature of the exhaust flow and opens it above this allowed temperature. The exhaust recycling is accordingly block during the hot-running of the internal combustion engine.

In addition, in FIG. 2, a check valve 51 which opens in the direction of the combustion chamber 11 and is formed as a flap valve, or as a diaphragm valve is arranged in each of the intake pipes 50 leading from the intake manifold 18 to the individual cylinders and combustion chamber 11, respectively, of the internal combustion engine. This check valve is arranged upstream of the injection nozzle in each instance and it is, accordingly, prevented that no recycled exhaust can be guided to the cylinder which is currently executing an intake stroke from the intake pipes 50 which are not connected at the moment to the respective combustion chamber 11 via the inlet valve 15. It is accordingly achieved that the recycling exhaust is always fed exclusively via the turbulence nozzle which is assigned to the respective cylinder executing an intake stroke. This increases the discharge speed and accordingly the turbulence and preparation of the fuel which is introduced into the sucked-in air flow via the injection nozzle 21. Of course, this construction can also be used in the embodiment according to FIG. 1 or also in carburetor internal combustion engine providing analogous advantage.

Figure 3:
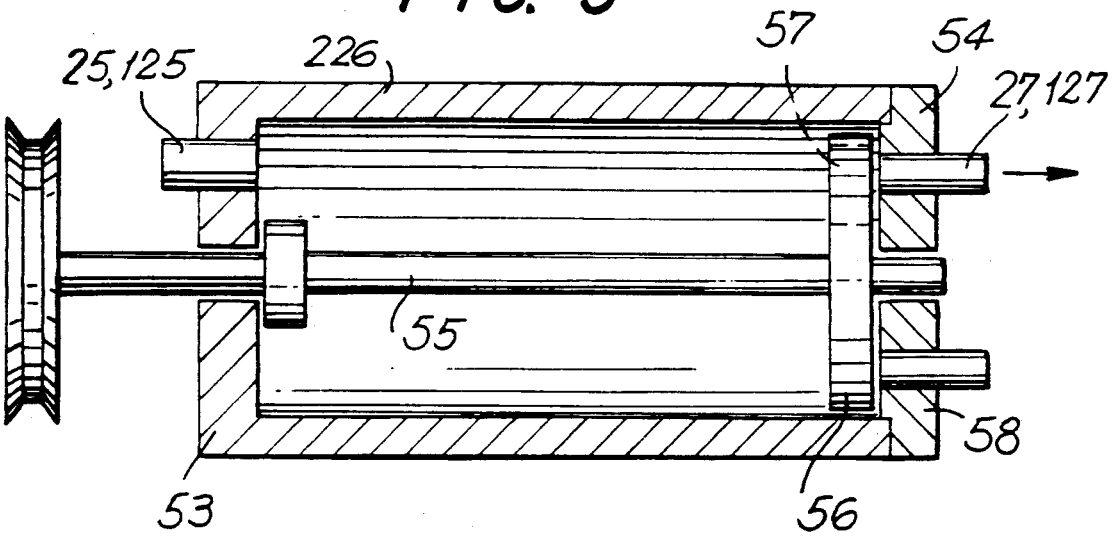
FIG. 3 shows a cross-sectional view of a header reservoir used in internal combustion engines shown in FIGS. 1 and 2 and combined with a distributor.

In constrast to the above arrangement, a header reservoir 226 shown in FIG. 3, replaces the header reservoir 26 and 126, respectively, of the embodiments according to FIGS. 1 and 2. The header reservoir 226 includes a closed circular cylinder, the exhaust return line 25 and 125, respectively, entering on one end face 53 of the circular cylinder and the separate exhaust return lines 27, 127 leading away on the other end face 54 of the closed circular cylinder. These exhaust return lines are arranged in the circuit at regular intervals and in the intake sequence of the combustion chambers assigned to them. A drive shaft 55 leads axially through the header reservoir 226, projects outward at one end face 53, and is driven in this location via the crankshaft of the internal combustion engine or its camshaft and is supported on the other side in the other end face 54. The drive shaft comprises a valve disk 56 tightly adjoining the inside of the other end face 54, which valve disk 56 covers the entire inside of the other end face 54 and comprises a control opening 57 through which each of the exhaust return lines 27 communicates with the interior space of the header reservoir 226 one after the other during the rotation of drive shaft 54. This valve disk 56 with drive shaft 55 constitutes a distributor 58 by which, depending on the rotational position of the valve disk, the exhaust flow fed via the exhaust return line 25, is guided further into the respective cylinder executing the intake stroke.

Figure 4:
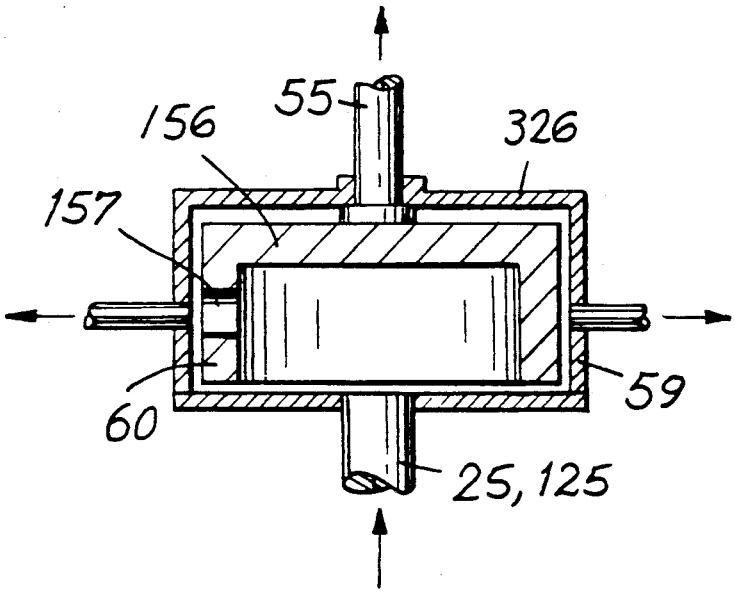
FIG. 4 shows a cross sectional view of a second embodiment of the head reservoir with distributor.

In an alternative embodiment to that of FIG. 3, the header reservoir 326, as shown in FIG. 4, is likewise constructed in a circular cylindrical manner. Only the exhaust return line 25, 125 open coaxially into the latter, and the exhaust return lines 27, 127 lead from the circumferential wall 59 of the header reservoir 326. A cup-shaped body, which covers the inside of the circumferential wall 59 of the header reservoir with its circumferential wall 60 and controls the individual exhaust return lines 25, 125 with a control opening 157 analogous to the construction according to FIG. 3, is provided here as a valve disk 156. The cup-shaped valve disk 156 is moved by a drive shaft guided through the end face of the header reservoir synchronously relative to the speed of the internal combustion engine.

In these embodiments, the exact exhaust recycling quantity is metered exclusively to that turbulence nozzle 28, 128 which is assigned to the respective cylinder executing an intake stroke. An optimal exhaust inflow velocity is adjusted at the turbulence nozzle, and any faulty metering or shifting forward of the exhaust recycling quantity is avoided in other cylinders which do not execute an intake stroke. In addition, the gas quantity fed to the burner can flow in without being impeded, which improves the density of the charge in the combustion chamber in comparison to the embodiment of FIG. 2.

While the invention has been illustrated and described as embodied in an internal combustion engine, particularly Otto engine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An internal combustion engine particularly Otto engine comprising:

an intake manifold including a throttle valve for controlling air flow therein;

an exhaust manifold;

a plurality of combustion cylinders, each combustion cylinder having a combustion chamber, an inlet chamber communicating with said intake manifold, an inlet valve for communicating said inlet chamber with said combustion chamber, an outlet chamber communicating with said exhaust manifold, and an outlet valve for communicating said combustion chamber with said outlet chamber;

exhaust recycling means comprising an exhaust return line connected with said exhaust manifold, an exhaust metering device communicating with said exhaust return line and including a first metering member actuatable jointly with said throttle valve of said intake manifold, and a second metering member located downstream of said first metering member and including a plurality of turbulence nozzles corresponding to said plurality of combustion cylinders, each of said turbulence nozzles being located immediately adjacent to a respective inlet valve of a respective combustion cylinder, said exhaust recycling means further comprising a header reservoir located downstream of said first metering member, and a plurality of separate exhaust return lines connecting said header reservoir with said plurality of turbulence nozzles; and a plurality of intake tubes for communicating said intake manifold with said plurality of combustion cylinders, each intake tube comprising an inlet opening communicating with a respective inlet chamber of a respective combustion cylinder and a check valve located upstream of said inlet opening for preventing backflow from said inlet chamber into said intake manifold.

2. An internal combustion engine according to claim 1, wherein said check valve is a diaphragm valve.

3. An internal combustion engine particularly Otto engine comprising:

an intake manifold including a throttle valve for controlling air flow therein;

an exhaust manifold;

a plurality of combustion cylinders, each combustion cylinder having a combustion chamber, an inlet chamber communicating with said intake manifold, an inlet valve for communicating said inlet chamber with said combustion chamber, an outlet chamber communicating with said exhaust manifold, and an outlet valve for communicating said combustion chamber with said outlet chamber;

exhaust recycling means comprising an exhaust return line connected with said exhaust manifold, an exhaust metering device communicating with said exhaust return line and including a first metering member actuatable jointly with said throttle valve of said intake manifold, and a second metering member located downstream of said first metering member and including a plurality of turbulence nozzles corresponding to said plurality of combustion cylinders, each of said turbulence nozzles being located immediately adjacent to a respective inlet valve of a respective combustion cylinder, said exhaust recycling means further comprising a header reservoir located downstream of said first metering member, a plurality of separate exhaust return lines connecting said header reservoir with said plurality of turbulence nozzles, said exhaust recycling means comprising a distributor connected with said header reservoir, and means drivable by the internal combustion engine for driving said distributor synchronously relative to the internal combustion engine, said distributor communicating separate exhaust return lines only with a respective cylinder executing an intake stroke in an intake sequence of said combustion cylinders of the internal combustion engine.

4. An internal combustion engine according to claim 3, wherein said header reservoir has a circular end face, said distributor comprising a valve disk covering said circular end face of said header reservoir, said valve disk having a control opening and is rotatable to connect a respective separate exhaust return line with said header reservoir in the intake sequence of respective combustion cylinders associated with said separate exhaust return line.

5. An internal combustion engine according to claim 3, wherein said header reservoir has a circumferential wall, said distributor comprising a cup-shaped valve disk driven synchronously relative to the internal combustion engine and having a circumferential wall in contact with said circumferential wall of said header reservoir, said valve disc comprising a control opening communicating with said separate exhaust return line in accordance with the intake sequence of the respective combustion cylinders associated with said separate exhaust return lines.

6. An internal combustion engine particularly Otto engine comprising:

an intake manifold including a throttle valve for controlling air flow therein;

an exhaust manifold;

a plurality of combustion cylinders, each combustion cylinder having a combustion chamber, an inlet chamber communicating with said intake manifold, an inlet valve for communicating with inlet chamber with said combustion chamber, an outlet chamber communicating with said exhaust manifold, and an outlet valve for communicating said combustion chamber with said outlet chamber;

exhaust recycling means comprising an exhaust return line connected with said exhaust manifold, an exhaust metering device communicating with said exhaust return line and including a first metering member actuatable jointly with said throttle valve of said intake manifold, and a second metering member located downstream of said first metering member and including a plurality of turbulence nozzles corresponding to said plurality of combustion cylinders, each of said turbulence nozzles being located immediately adjacent to a respective inlet valve of a respective combustion cylinder, said exhaust recycling means further comprising a header reservoir located downstream of said first metering member, and a plurality of separate exhaust return lines connecting said header reservoir with said plurality of turbulence nozzles, said metering member being located in an immediate vicinity of said exhaust manifold.

7. An internal combustion engine particularly Otto engine comprising:

an intake manifold including a throttle valve for controlling air flow therein;

an exhaust manifold;

a plurality of combustion cylinders, each combustion cylinder having a combustion chamber, an inlet chamber communicating with said intake manifold, an inlet valve for communicating said inlet chamber with said combustion chamber, an outlet chamber communicating with said exhaust manifold, and an outlet valve for communicating said combustion chamber with said outlet chamber;

exhaust recycling means comprising an exhaust return line connected with said exhaust manifold, an exhaust metering device communicating with said exhaust return line and including a first metering member actuatable jointly with said throttle valve of said intake manifold, and a second metering member located downstream of said first metering member and including a plurality of turbulence nozzles corresponding to said plurality of combustion cylinders, each of said turbulence nozzles being located immediately adjacent to a respective inlet valve of a respective combustion cylinder, said exhaust recycling means further comprising a header reservoir located downstream of said first metering member, and a plurality of separate exhaust return lines connecting said header reservoir with said plurality of turbulence nozzles; an ignition time of a combustion mixture in the combustion chamber of each of said combustion cylinders being controlled to an optimal combustion position, and the ignition in the combustion chamber of each of said combustion cylinders being controlled to the optimal combustion position independently of optimal combustion position control of others of said combustion cylinders.

8. An internal combustion engine according to claim 7, further comprising an electronic control device for controlling an ignition angle and an injection period of fuel injected in respective cylinders in accordance with a position of said throttle valve of said intake manifold, speed of the internal combustion engine, air index, coolant water temperature measured at a cylinder heads of respective combustion cylinders and a combustion configuration of respective combustion chambers of respective combustion cylinders.

9. An internal combustion engine according to claim 8, wherein each of said combustion cylinders comprises a spark plug for providing a respective combustion chamber light configuration to be optically detected.

10. An internal combustion engine according to claim 9, further comprising a catalytic converter connected with said exhaust manifold, said electronic control device adjusting the ignition angle and the fuel-air mixture produced by a carburetor in such a way that the air index ($\lambda$) is regulated to 1.

11. An internal combustion engine according to claim 9, further comprising a catalytic converter connected with said exhaust manifold, said electronic control device controlling the ignition angle and the fuel-air mixture produced by an injection nozzle in such a way that the air index ($\lambda$) is controlled to 1.

12. An internal combustion engine particularly Otto engine comprising:

an intake manifold including a throttle valve for controlling air flow therein;

an exhaust manifold;

a plurality of combustion cylinders, each combustion cylinder having a combustion chamber, an inlet chamber communicating with said intake manifold, an inlet valve for communicating said inlet chamber with said combustion chamber, an outlet chamber communicating with said exhaust manifold, and an outlet valve for communicating said combustion chamber with said outlet chamber;

exhaust recycling means comprising an exhaust return line connected with said exhaust manifold, an exhaust metering device communicating with said exhaust return line and including a first metering member actuatable jointly with said throttle valve of said intake manifold, and a second metering member located downstream of said first metering member and including a plurality of turbulence nozzles corresponding to said plurality of combustion cylinders, each of said turbulence nozzles being located immediately adjacent to a respective inlet valve of a respective combustion cylinder, said exhaust recycling means further comprising a header reservoir located downstream of said first metering member, and a plurality of separate exhaust return lines connecting said header reservoir with said plurality of turbulence nozzles, said first metering member being formed as a mechanically actuatable metering valve connected with one of said throttle valves of said intake manifold and accelerator pedal with a Bowden cable.

13. An internal combustion engine according to claim 12, wherein said exhaust return line has a first line segment connected with said exhaust manifold and a second line segment connected with said header reservoir, said metering valve being located between said second line segments and including first and second valve portions, a valve opening communicating said first and second valve portions, a valve seat enclosing said valve opening, a valve member cooperating with said valve seat for communicating said first and second valve portions through said valve opening, and a valve spring for biasing said valve member in a closing direction thereof, said valve member being connected with said Bowden cable acting on said valve member in an opening direction thereof.

14. An internal combustion engine according to claim 13, wherein said valve seat is an annular valve seat, and said valve member comprises a conical valve closing member cooperating with said annular valve seat.

15. An internal combustion engine according to claim 12, wherein said said metering valve is located in said exhaust return line, said exhaust return line comprising a very short first line segment communicating between said metering valve and said exhaust manifold, each of said separate exhaust return lines comprising a very short exhaust return portion for communicating said header reservoir with a respective turbulence nozzle.

* * * * *